US008371896B2

(12) United States Patent
Baytman et al.

(10) Patent No.: US 8,371,896 B2
(45) Date of Patent: Feb. 12, 2013

(54) METHOD AND APPARATUS FOR PERFORMING TRY-ME AND NORMAL PLAY ROUTINES

(75) Inventors: Alexander L. Baytman, Fairlawn, NJ (US); Konstantin Degtyarev, River Edge, NJ (US)

(73) Assignee: Mattel, Inc., El Segundo, CA (US)

( * ) Notice: Subject to any disclaimer, the term of this patent is extended or adjusted under 35 U.S.C. 154(b) by 844 days.

(21) Appl. No.: 12/351,384

(22) Filed: Jan. 9, 2009

(65) Prior Publication Data

US 2009/0181598 A1 Jul. 16, 2009

Related U.S. Application Data

(60) Provisional application No. 61/020,914, filed on Jan. 14, 2008.

(51) Int. Cl.
*A63H 30/00* (2006.01)
*B65D 25/54* (2006.01)

(52) U.S. Cl. ..... 446/175; 446/484; 206/775

(58) Field of Classification Search ..... 446/175, 446/484, 267; 206/775, 779–780, 457; 340/12.3, 340/12.31

See application file for complete search history.

(56) References Cited

U.S. PATENT DOCUMENTS

| | | | |
|---|---|---|---|
| 3,142,130 | A | 7/1964 | Weitzell |
| 3,229,421 | A | 1/1966 | Ostrander |
| 3,514,899 | A | 6/1970 | Bonanno et al. |
| 4,348,191 | A | 9/1982 | Lipsitz et al. |
| 4,563,626 | A | 1/1986 | Ohtake |
| 4,699,603 | A | 10/1987 | Saigo et al. |
| 4,702,374 | A | 10/1987 | Kelner |
| 4,842,564 | A | 6/1989 | Gerold et al. |
| 4,925,025 | A | 5/1990 | Anten et al. |
| 4,964,837 | A | 10/1990 | Collier |
| 5,147,237 | A | 9/1992 | Kwan et al. |
| 5,158,495 | A | 10/1992 | Yonezawa |
| 5,172,806 | A | 12/1992 | Mickelberg |
| 5,173,071 | A | 12/1992 | Hoeting |
| 5,188,222 | A | 2/1993 | Pierce |

(Continued)

FOREIGN PATENT DOCUMENTS

| | | |
|---|---|---|
| EP | 0928626 | 7/1999 |
| EP | 1221335 A2 | 7/2002 |

(Continued)

OTHER PUBLICATIONS

Partial European Search Report issued Jun. 18, 2009, 4 pages.

(Continued)

*Primary Examiner* — Dmitry Suhol
*Assistant Examiner* — Alex F. R. P. Rada, II
(74) *Attorney, Agent, or Firm* — Panitch Schwarze Belisario & Nadel LLP

(57) ABSTRACT

A toy includes electronics which generates a plurality of routines and is configured to operate in a first mode and in a second mode, a first sensor and a second sensor, each sensor operably connected to the electronics. Actuation of the first sensor causes the electronics to generate a first routine with the electronics in the first mode and to generate a second routine, different from the first routine, with the electronics in the second mode. Activation of the second sensor causes the electronics to generate of a third routine, different from the first routine, and causes the electronics to be set to the second mode. The electronics is set to the first mode upon a first application of electrical power to the electronics.

17 Claims, 3 Drawing Sheets

U.S. PATENT DOCUMENTS

| | | | | |
|---|---|---|---|---|
| 5,283,567 | A | 2/1994 | Howes | |
| 5,289,916 | A | 3/1994 | Mickelberg | |
| 5,290,198 | A | 3/1994 | Nakayama | |
| 5,324,225 | A | 6/1994 | Satoh et al. | |
| 5,334,076 | A | 8/1994 | Shinozuka | |
| 5,410,326 | A | 4/1995 | Goldstein | |
| 5,411,138 | A | 5/1995 | Klawiter | |
| 5,442,986 | A | 8/1995 | Cota | |
| 5,453,000 | A | 9/1995 | Lebensfeld | |
| 5,465,909 | A | 11/1995 | Roth | |
| 5,525,972 | A | 6/1996 | Inokoshi | |
| 5,607,336 | A | 3/1997 | Lebensfeld et al. | |
| 5,607,338 | A | 3/1997 | Landi | |
| 5,622,258 | A | 4/1997 | Baublitz et al. | |
| 5,628,631 | A | 5/1997 | Aneha | |
| 5,636,741 | A * | 6/1997 | O'Keefe | 206/459.1 |
| 5,691,578 | A * | 11/1997 | Driska | 307/112 |
| 5,713,779 | A | 2/1998 | Chen | |
| 5,718,335 | A | 2/1998 | Boudreaux | |
| 5,741,185 | A | 4/1998 | Kwan et al. | |
| 5,795,209 | A | 8/1998 | Moore | |
| 5,858,262 | A | 1/1999 | Lebensfeld | |
| 5,905,429 | A | 5/1999 | Hornstein et al. | |
| 5,984,788 | A | 11/1999 | Lebensfeld et al. | |
| 5,992,629 | A | 11/1999 | Gullord et al. | |
| 6,011,489 | A | 1/2000 | Ki Kwan et al. | |
| 6,021,941 | A | 2/2000 | Schultz | |
| 6,028,533 | A | 2/2000 | Javors | |
| 6,071,166 | A | 6/2000 | Lebensfeld et al. | |
| 6,139,087 | A | 10/2000 | Wolfmaier et al. | |
| 6,311,837 | B1 | 11/2001 | Blaustein et al. | |
| 6,319,087 | B1 * | 11/2001 | Ferrigno | 446/297 |
| 6,377,187 | B1 | 4/2002 | Fong | |
| 6,437,703 | B1 | 8/2002 | Fong | |
| 6,520,828 | B2 * | 2/2003 | Ferrigno | 446/330 |
| 6,705,919 | B2 | 3/2004 | Curran et al. | |
| 6,727,826 | B1 * | 4/2004 | Ki Kwan et al. | 340/12.3 |
| 6,749,437 | B2 | 6/2004 | Chan | |
| 6,758,716 | B1 * | 7/2004 | Rehkemper et al. | 446/297 |
| 6,889,829 | B2 | 5/2005 | Lev et al. | |
| 6,896,573 | B1 * | 5/2005 | Rogers | 446/8 |
| 6,909,374 | B2 | 6/2005 | Fong | |
| 6,948,999 | B2 * | 9/2005 | Chan | 446/219 |
| 7,088,259 | B2 | 8/2006 | Armbruster et al. | |
| 7,094,981 | B2 | 8/2006 | Sorrentino et al. | |
| 7,120,257 | B2 | 10/2006 | Mahoney | |
| 7,356,952 | B2 | 4/2008 | Sweeney et al. | |
| 7,422,506 | B2 | 9/2008 | Lund et al. | |
| 7,448,969 | B2 | 11/2008 | Weber et al. | |
| 7,578,393 | B2 * | 8/2009 | Gillon | 206/774 |
| 7,641,052 | B2 * | 1/2010 | Calendrille, Jr. | 206/779 |
| 2001/0034181 | A1 * | 10/2001 | Bakst | 446/242 |
| 2002/0106624 | A1 | 8/2002 | Chan | |
| 2003/0066145 | A1 | 4/2003 | Prineppi | |
| 2003/0114075 | A1 * | 6/2003 | Moll et al. | 446/456 |
| 2004/0087241 | A1 * | 5/2004 | Agostini et al. | 446/36 |
| 2005/0284788 | A1 | 12/2005 | Elliott et al. | |
| 2006/0014472 | A1 * | 1/2006 | Spielberger | 446/477 |
| 2006/0207901 | A1 | 9/2006 | Sorrentino et al. | |
| 2006/0270312 | A1 * | 11/2006 | Maddocks et al. | 446/337 |
| 2007/0031808 | A1 | 2/2007 | Wei | |
| 2007/0042614 | A1 | 2/2007 | Marmaropoulos et al. | |
| 2007/0082764 | A1 | 4/2007 | Weber et al. | |
| 2007/0138923 | A1 | 6/2007 | Sokola | |
| 2007/0184722 | A1 | 8/2007 | Doherty | |
| 2008/0129530 | A1 | 6/2008 | Lokos | |
| 2008/0202003 | A1 | 8/2008 | Sweeney et al. | |

FOREIGN PATENT DOCUMENTS

| | | |
|---|---|---|
| WO | WO-99/03549 | 1/1999 |
| WO | WO-99/35627 | 7/1999 |

OTHER PUBLICATIONS

EP Supplemental Search Report issued on Jun. 16, 2010 in EP Application No. 09000454.0-2318.

Office Action Issued Oct. 14, 2010 in Chinese Appln. No. 200910126761.0.

Office Action issued Oct. 9, 2011 in CN Application No. 200910126761.0.

* cited by examiner

METHOD AND APPARATUS FOR PERFORMING TRY-ME AND NORMAL PLAY ROUTINES

CROSS-REFERENCE TO RELATED APPLICATIONS

This application claims the benefit of provisional application No. 61/020,914, filed Jan. 14, 2008, the contents of which are incorporated by reference in the entirety.

BACKGROUND OF THE INVENTION

Try-me is generally known as an operating mode of a toy which in it's normal mode provides one or more normal play routines and which provides in the try-me mode one or more abbreviated play routines compared to the toy's normal play routines. Typically, a toy having a try-me mode is set by the manufacturer to operate in the try-me mode while the toy is in a package on a store shelf. By providing a toy with a try-me mode, the user is able gain some idea of the toy's capabilities while the toy is still in the package on the store shelf. Try-me is especially useful for battery operated toys having a normal play routines of complicated scripts, long performance patterns, motor operation, displays, sounds and/or lights which consume a relatively large amount of battery energy.

Generally, switching between the try-me mode and a mode in which normal play routines are performed (i.e. normal mode) is done by detecting the state of a try-me switch by a computer chip controlling the modes and routines of the toy. Such a try-me switch is generally distinct from the switches which are used by the user for selecting a particular play routine.

In the prior art, the user is required to take some positive action distinct from selecting a play routine to switch the toy from the try-me mode to the normal mode. One known method of switching between try-me mode and the normal mode uses a removable tab which, while in place in the toy, actuates the try-me switch to put the toy into a try-me state. The tab, often a thin piece of plastic, sometimes with an appropriate message (for example, "Discard by adult, pull out for normal play mode") is removed either automatically when the toy is removed from the package or manually by the user after the toy is removed from the package to enable the normal play mode.

It would be desirable to have a method of switching between try-me mode and normal mode of operation that does not require an additional component such as a separate switch for affecting the switching between try-me mode and normal mode, or does not require the user to take a specific action distinct from selecting a play routine, such as removing the tab.

SUMMARY OF THE INVENTION

A first aspect of the invention in its broadest form is a toy comprising: electronics configured to generate a plurality of routines and to operate in a first mode and in a second mode; a first sensor operably connected to the electronics, user actuation of which causes the electronics to generate a first routine with the electronics is in the first mode and to generate a second routine, different from the first routine with the electronics in the second mode; and a second sensor operably connected to the electronics, user actuation of which causes the electronics to generate of a third routine, different from the first routine and the second routine, and causes the electronics to be set to the second mode.

A second aspect of the invention in its broadest form is a method of operating a toy having electronics configured to operate in a first mode and a second mode, a first sensor operably connected to the electronics and a second sensor operably connected to the electronics, the method comprising the steps of: setting the electronics to be in the first mode upon a first application of electrical power to the electronics; user actuating the first sensor to cause the electronics to generate a first routine with the electronics in the first mode and to generate a second routine different from the first routine with the electronics in the second mode; and user actuating the second sensor to cause the electronics to generate a third routine different from the first routine and the second routine and to cause the electronics to be set to the second mode.

A third aspect of the invention is a packaged toy comprising: a toy including a plurality of user actuated switches, a computer chip controller in the toy operatively connected with each of the plurality of user actuated switches, and a plurality of preprogrammed routines stored in the toy, each routine directing controller activation and operation of the toy in a different way, the plurality of preprogrammed routines including at least a first set of one or more try-me routines; and a second set of two or more normal routines, and each of the plurality of switches being associated with one or more particular routines of the plurality. It further comprises a package containing the toy and configured to expose one or more of the plurality of switches to permit user actuation of the at least the one or more exposed switches with the toy in the package and to cover one or more remaining switches of the plurality of switches to prevent user actuation of the one or more remaining switches with the toy in the package before the package is opened. The controller is configured to (1) initially execute only preprogrammed try-me routines of the first set in response to activations of the one or more switches of the plurality exposed to user actuation with the toy in the package, (2) execute one of the preprogrammed normal routines of the second set in direct response to user activation of any of the remaining switches, and (3) thereafter execute preprogrammed normal routines from the second set in response to actuation of any of the one or more switches exposed to the user with the toy in the package, at least one of the preprogrammed normal routines executable by the controller after (2) in response to activation of any of the one or more switches exposed with the toy in the package being different from each of the preprogrammed try-me routines of the first set, whereby the toy automatically reconfigures itself from a try-me mode of operation to a normal play mode of operation.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
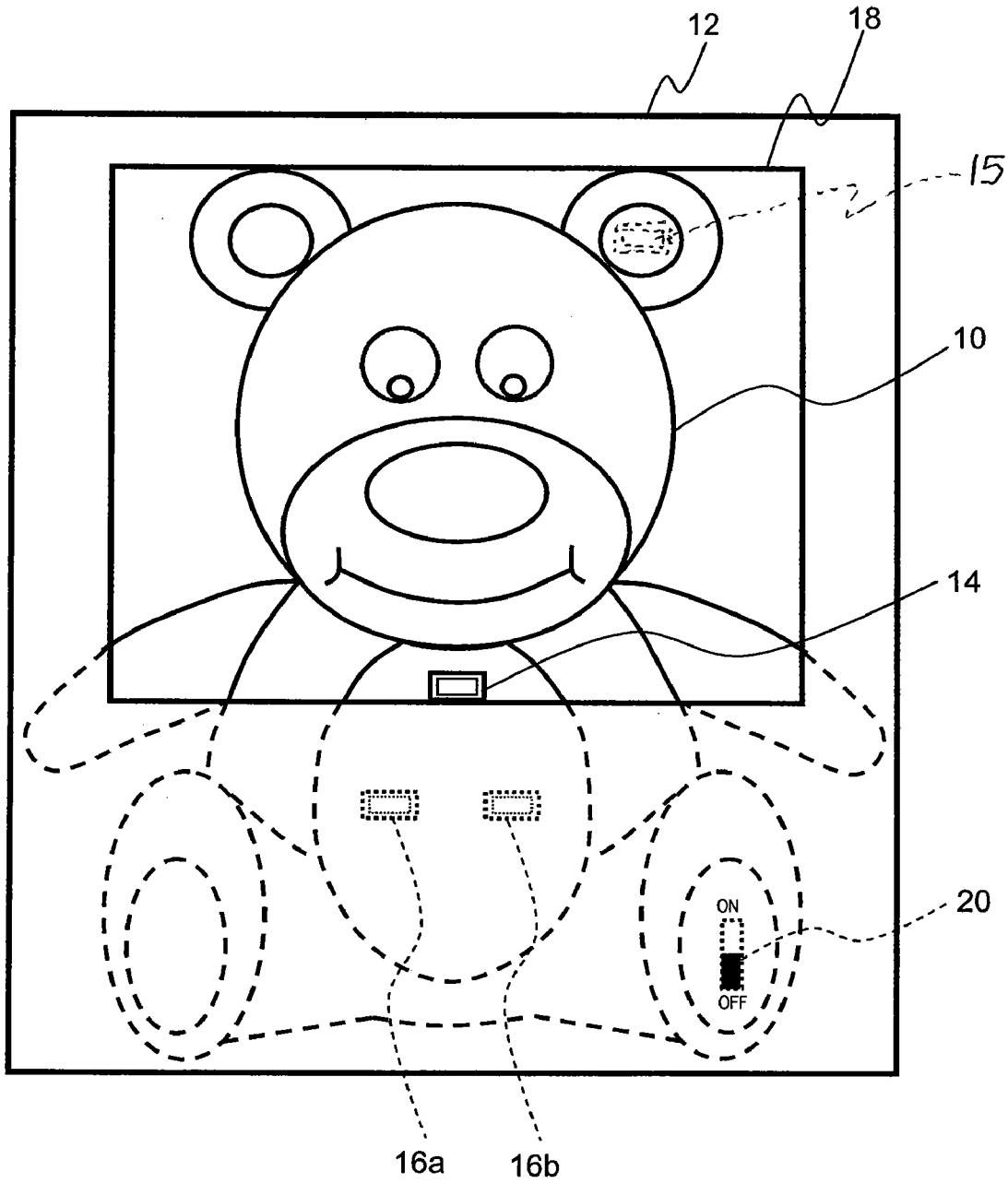
FIG. 1 is a plan view of a preferred embodiment of package in combination with a toy having a try-me mode.

Referring now to FIG. 1 there is shown the combination of a toy 10 contained in a package 12. The toy 10 is initially inserted into the package 12 with a source of power such as one or more batteries (LR44 in FIG. 2). The toy 10 includes a plurality of sensors at various locations on or in the toy 12 that are user activated to cause the toy to operate in predetermined ways. In the depicted embodiment, the package 12 has a cutout 18 through which a portion of the enclosed toy 10 is visible and accessible to a user. The toy 10 and package 12 are configured to expose at least a first sensor 14 for user access and activation with the toy 10 in the package 12 and to cover or otherwise to prevent user access and actuation of at least a second sensor 16 with the toy 10 in the package 12.

There is no limit to the number of user activated sensors that may be included with the toy 10. Yet a third sensor 17 may be provided with the second sensor 16 to be covered by the package 12 while a fourth sensor 15 can be provided exposed with the toy 10 in the package 12 for user manual activation of the toy 10 in the package 12. Sensors used in the present invention are devices that respond to a user initiated physical stimulus such as heat, light, sound, pressure, magnetism or a particular motion and transmit a resulting impulse or other electrical signal. In the preferred embodiment of the present invention, each of the sensors 14-17 is preferably a switch on or in the toy 10, which is manually actuated to make or break the flow of electrical current. Sensors 14-17 may also be subsequently referred to as switches.

Figure 2:
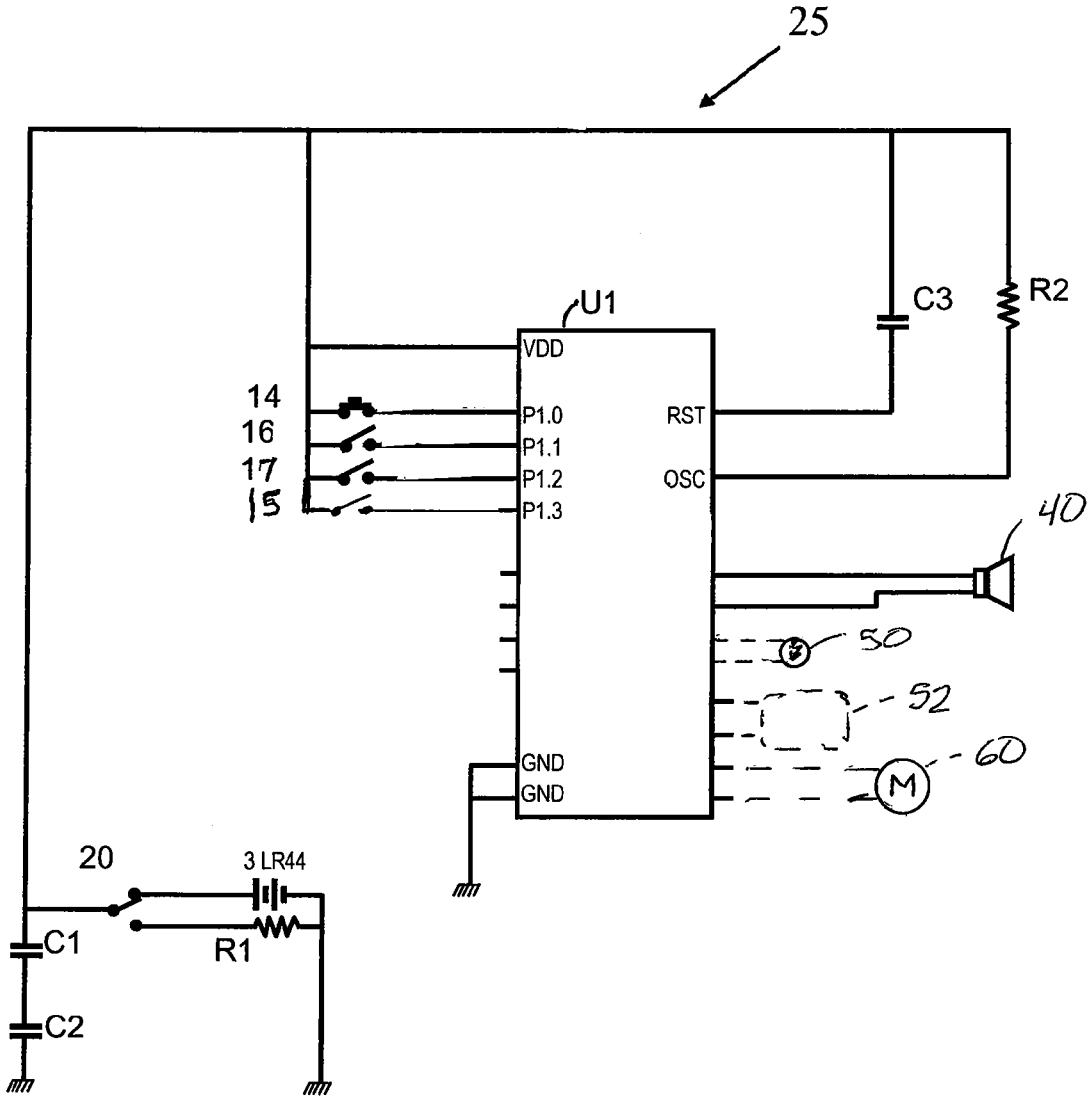
FIG. 2 is a schematic circuit diagram of electronics for implementing the preferred embodiment.

Referring to FIG. 2, the toy 10 also includes electronics indicated generally at 25. Each of the sensors 14-17 is operably connected to the electronics 25. The toy 10 also includes at least one and preferably a plurality of electrically operated or electronically responsive devices such as one or more sound generators like speaker 40, one or more light generators like LED 50 or even like a display screen 52, and/or one or more electrically controlled prime movers like motor 60 or solenoids, pumps, etc. to make the toy responsive to the user. Each device 40, 50, 52, 60 is operably connected with the electronics 25 to be controlled (activated and operated) by the electronics 25. The electrically controlled devices are not limited to those enumerated above.

The toy 10 is made to respond in a variety of different ways through the various provided devices 540, 50, 52, 60, etc., to user activation of the sensors 14-17. Each different way is referred to as a routine. Reference to "routine" hereinafter in describing the present invention denotes a finite duration activity of the toy 10, which may include generation of sound, light, heat, magnetic, electrostatic or electro-magnetic mechanical activity or any combination of the above, under the control of the electronics 25. The electronics 25 are configured to "generate" the routines in that the electronics include sets of predetermined instructions that direct the electronics 25 (and computer chip 20 in particular) to activate and operate the toy 10 by control of the operation of the various devices 40, 50, 52, 60, etc. in accordance with those instructions. Each routine typically requires a separate set of predetermined instructions to be stored in the electronics 25 and "routine" should also be understood to refer to a set of instructions as well as the physical activities.

According to the invention, the toy 10 and the electronics 25 are provided with at least a first routine (hereafter also referred to as a "try-me" routine), and at least second and third routines (hereafter also referred to as "normal" or "normal play" routines). Try-me routines are generally abbreviated in some manner compared the normal routines in order to conserve battery life. A try-me routine lets the user exercise one or more of the devices that can be exercised with the toy 10 in the package 12 to give the user a glimpse of the operating capabilities of the toy 10 without draining the batteries before the toy 10 is removed from the package 12.

While only a single try-me routine and two normal routines are required by the invention, the only limit to the number of try-me routines and normal routines that the toy 10 has is the capacity of the toy 10 and electronics 25 to store instructions. Typically, a first set of a limited number of try-me routines and a second set of normal routines much greater in number than the number of try-me routines, are stored preprogrammed in the toy 10 and electronics 25 for enhanced and more varied operation of the toy in normal use.

There may even be a correspondence between routines with a try-me routine being a normal routine truncated to be shorter in duration or having fewer attributes (fewer activations of sound, light, movement and/or other activity of the toy) or both shorter duration and fewer activations than a particular normal routine. Conversely, normal routines are more extensive, i.e. longer in duration and/or have a greater number of attributes or activations such as greater variety of sounds, mechanical operation and/or light operation(s), with a resulting greater power drain than all or at least nearly all of the provided try-me routines exercising the same devices.

The toy 10 is configured through configuration of the electronics 25 to operate in two different modes, a first or "try-me" mode and a second or "normal" or "normal play" mode. Only the try-me routines are performed while the toy 10 and the electronics 25 are in the first or try-me mode. Normal routines are performed only while the toy 10 and electronics 25 are in the second or normal mode. This distinction is important. Normal routines cannot be performed by the toy in the try-me mode of operation but the toy and electronics can be configured to continue to perform one or more try-me routines in the normal mode of operation.

According to the invention, the toy 10 and electronics 25 are configured to change from the try-me to the normal mode of operation by user actuation of one of the normal routine activating sensors. Toy 10 and package 12 are configured to expose sensors 14 and 15 to user access with the toy 10 contained in the package 12. Sensors 14, 15 constitute a first or "try-me" subset of the sensors. Toy 10 and package 12 are further configured to cover or otherwise prevent user access to sensors 16, 17 with the toy 10 contained in the package 12. Sensors 16, 17 constitute a second or "normal" or "normal play" subset of the sensors. With the toy 10 removed from the package 12, either by normal opening or by destruction of the package 12 around the toy, at least the second sensor 16 and/or the third sensor 17 of the second subset of sensors, become user accessible.

Further according to the invention, user activation of a first sensor (like sensor 14) operably connected to the electronics 25 configured in the first or try-me mode causes the electronics 25 to generate at least a first routine, a try-me routine, and with the electronics 25 in the second mode, to generate at least a second routine, a normal routine, which is different from the first routine. Further according to the invention, user activation of a second sensor (like sensor 16) operably connected to the electronics 25 and different from the first sensor causes the electronics 25 to generate a third routine different from the first routine, and also causes the electronics 25 to set itself to the second or normal mode. These are minimum requirements of the invention.

More preferably, the electronics 25 are configured to generate any of a first subset of the stored try-me routines in response to user activation of the first sensor 14 with the electronics 25 in the first or try-me mode. The electronics 25 are further configured to generate any of a second subset of the stored normal routines, where the normal routines are different from each try-me routine that is provided, but can be generated only with the electronics 25 in the second or normal mode. The same is true of user activation of the fourth sensor 15 although the electronics 25 will typically store separate subsets of try-me and normal routines different from the routines and subsets stored for response to the first sensor 14. The electronics 25 are similarly configured to respond to the first user actuation of either the second 16 or the third sensor 17 to generate a normal routine from a separate subset of stored normal routines and to set itself to the second or normal mode of operation. In this way, each of the sensors 14-17 is typically associated with one or more particular routines of all those routines stored in the toy 10.

Referring to FIG. 2, preferably, the electronics 25 includes a controller indicated diagrammatically as a computer chip U1 to receive signals from the switches 14-17 and to store and execute the commands constituting the routines, which produce the activities associated with routines. Computer chip U1 is conventional and includes all necessary memory and processing capability as well as any other capability needed to activate, operate, control the various provided devices 40, 50, 52, 60, etc. However, it is not necessary that a computer chip be used in the electronic portion 25. The electronics 25 may be a comprised of discrete components such as resistors, capacitors and transistors mounted on one or more substrates. Alternatively, a combination of individual computer chips and/or discrete computer components may be used.

Preferably, the electronics 25 are set or configured to be in or to enter the first or (try-me) mode of operation upon a first application of electrical power to the electronics 25. This means the electronics 25 may be configured to be set to the first mode each time the electrical power to the electronics 25 is interrupted and reapplied to the electronics 25, or the electronics 25 may be configured to be set to the first mode only the first time electrical power is applied to the electronics 25 and never again thereafter regardless of whether power is subsequently interrupted and reapplied.

The toy 10 may include a mechanical on-off switch 20 for controlling the application of the battery power to the toy 10. If provided, the on-off switch 20 is set to the "on" position when the toy 10 is inserted into the package 12 by the manufacturer and is preferably concealed from a user while the toy 10 is enclosed in the package 12. Preferably, the first application of electrical power occurs by operation of the on-off switch 20 from the "off" position to the "on" position after installation of the batteries or installation of the batteries by the manufacturer while the switch 20 is in the "on" position.

Figure 3:
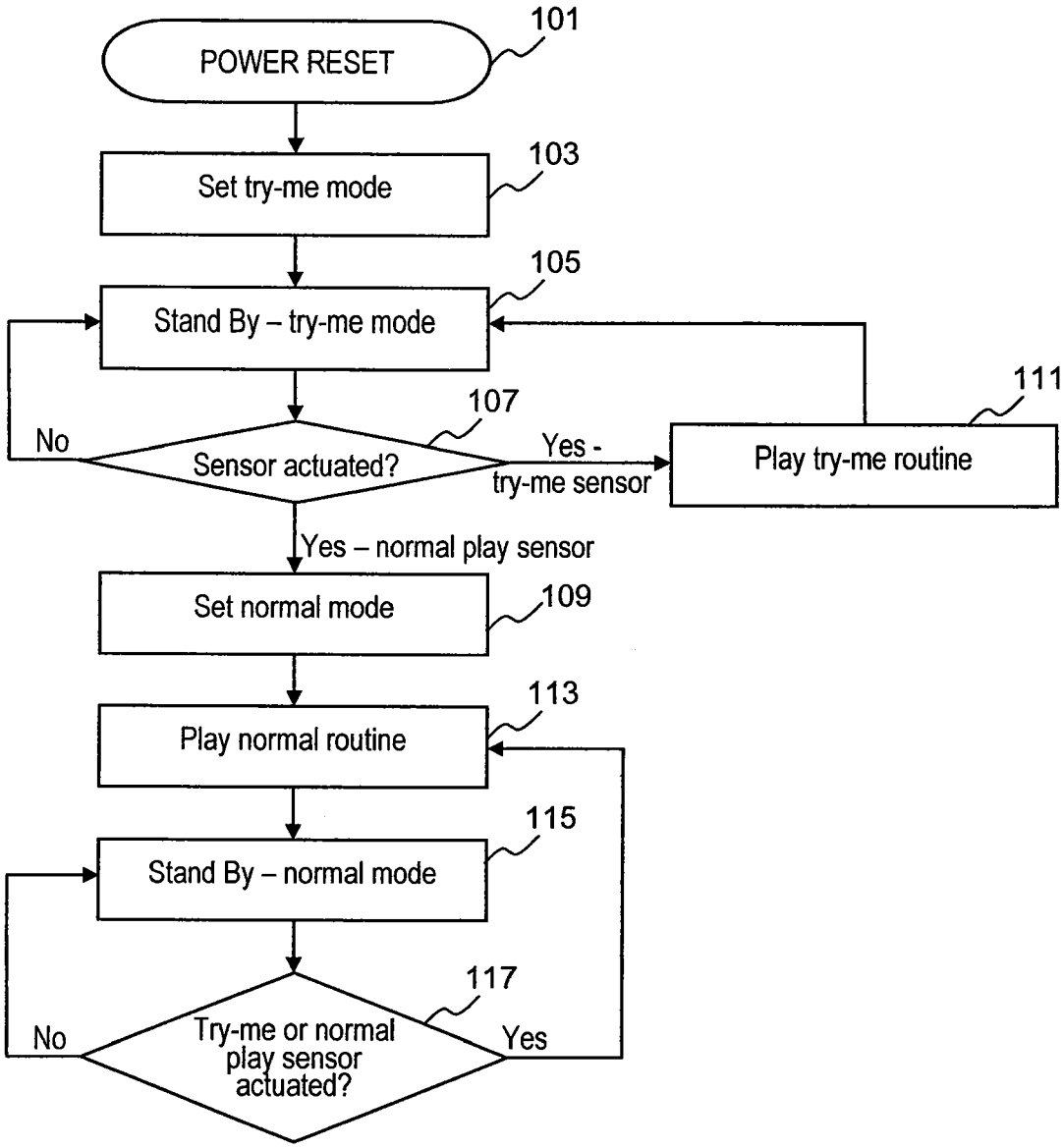
FIG. 3 is a flowchart of a preferred method for switching between try-me and normal modes.

FIG. 3 depicts operation of a preferred embodiment toy 10. With a source of power such as batteries installed in the toy 10, the try-me mode is entered the first time the power to the toy 10 is turned from off to on by actuation of the on-off switch 20 with the batteries installed, or by batteries LR44 being added or replaced while the switch 20 is in the "on" position (step 101). Upon sensing the change in power, the computer chip U1 enters the try-me mode (step 103). Generally, the toy 10 is pre-programmed to be in the try-me mode by the manufacturer and is in the try-me mode when placed in the package 12 by the manufacturer.

While in the try-me mode, the computer chip controller U1 periodically queries the state of each play routine switch 14-17 (step 107) to determine if any one of the switches 14-17 has been actuated. If a try-me switch 14, 15 is actuated, a try-me routine is performed (step 111) and thereafter, the toy 10 returns to the try-me mode (step 105). If no switch 14-17 is actuated, the toy 10 stays in the try-me mode (step 105).

In the preferred embodiment, if a normal routine switch 16 or 17 is actuated while the toy 10 is in the try-me mode, the toy 10 automatically switches to the normal mode (step 109) and performs a normal routine corresponding to the switch 16, 17 that was actuated (step 113). Following the performance of the selected normal routine (step 113), the toy 10 remains in the normal mode (step 115) until reset (step 101). In the normal mode, the computer chip U1 periodically queries the state of each play routine switch 14-17 to determine if any one of the switches 14-17 has been activated (step 117). If any switch 14-17 is actuated, a normal routine associated with the activated switch is performed (step 113). If no switch 14-17 is actuated, the toy 10 stays in the normal mode (step 115).

If the toy 10 is configured for a one time try-me configuration, the electronics 25 will be configured to automatically advance to step 115 each time power is interrupted and reapplied.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A packaged toy comprising:

a toy including:

electronics configured to generate a plurality of routines and to operate in a first mode and in a second mode;

a first sensor operably connected to the electronics, user actuation of which causes the electronics to generate a first routine with the electronics in the first mode and to generate a second routine, different from the first routine, with the electronics in the second mode; and a second sensor operably connected to the electronics, user actuation of which causes the electronics to generate a third routine, different from the first routine, and causes the electronics to be set to the second mode; and a package containing the toy, the toy and the package being configured to expose the first sensor for actuation by a user with the toy contained in the package and to prevent user actuation of the second sensor with the toy contained in the package, the electronics being in the first mode in the package;

wherein the electronics is reset to the first mode each time electrical power to the electronics is interrupted and reapplied to the electronics.

2. The packaged toy of claim 1, wherein the second routine is more extensive than the first routine.

3. The packaged toy of claim 1, wherein the second sensor is covered by the package with the toy contained in the package.

4. The toy of claim 1 wherein:

the first mode is a try-me mode and the first routine is a try-me routine; and the second mode is a normal mode and the second and third routines are normal routines, the normal routines only being generated by the electronics with the electronics in the second, normal mode.

5. A packaged toy comprising:

a toy including:

electronics configured to generate a plurality of routines and to operate in a first mode and in a second mode;

a first sensor operably connected to the electronics, user actuation of which causes the electronics to generate a first routine with the electronics in the first mode and to generate a second routine, different from the first routine, with the electronics in the second mode; and a second sensor operably connected to the electronics, user actuation of which causes the electronics to generate a third routine, different from the first routine, and causes the electronics to be set to the second mode; and a package containing the toy, the toy and the package being configured to expose the first sensor for actuation by a user with the toy contained in the package and to prevent user actuation of the second sensor with the toy contained in the package, the electronics being in the first mode in the package;

wherein the electronics is set to the first mode only a first time electrical power is applied to the electronics.

6. The packaged toy of claim 5, wherein the second sensor is covered by the package with the toy contained in the package.

7. The toy of claim 5 wherein:

the first mode is a try-me mode and the first routine is a try-me routine; and the second mode is a normal mode and the second and third routines are normal routines, the normal routines only being generated by the electronics with the electronics in the second, normal mode.

8. A method of operating a toy initially in a package, the toy having electronics configured to operate in a first mode and a second mode, a first sensor operably connected to the electronics and a second sensor operably connected to the electronics, the toy in the package being internally powered with the electronics configured in the first mode, the method comprising the steps of:

user actuating the first sensor to cause the electronics to generate a first routine with the electronics in the first mode and to generate a second routine different from the first routine with the electronics in the second mode, at least the first sensor being exposed on the toy in the package for user actuation of the toy to generate the first routine in the package and at least the second sensor being covered in the package to prevent user actuation of the second sensor with the toy in the package;

removing the toy from the package sufficiently to expose at least the second sensor for user actuation;

user actuating the second sensor to cause the electronics to generate a third routine different from the first routine and to cause the electronics to be set to the second mode; and after the second actuating step, the step of resetting the electronics to the first mode upon a reapplication of electrical power to the electronics.

9. The method of claim 8, wherein the second routine is more extensive than the first routine.

10. A method of operating a toy initially in a package, the toy having electronics configured to operate in a first mode and a second mode, a first sensor operably connected to the electronics and a second sensor operably connected to the electronics, the toy in the package being internally powered with the electronics configured in the first mode, the method comprising the steps of:

user actuating the first sensor to cause the electronics to generate a first routine with the electronics in the first mode and to generate a second routine different from the first routine with the electronics in the second mode, at least the first sensor being exposed on the toy in the package for user actuation of the toy to generate the first routine in the package and at least the second sensor being covered in the package to prevent user actuation of the second sensor with the toy in the package;

removing the toy from the package sufficiently to expose at least the second sensor for user actuation;

user actuating the second sensor to cause the electronics to generate a third routine different from the first routine and to cause the electronics to be set to the second mode; and further including the step of resetting the electronics to the first mode each time electrical power to the electronics is interrupted and reapplied to the electronics.

11. A method of operating a toy initially in a package, the toy having electronics configured to operate in a first mode and a second mode, a first sensor operably connected to the electronics and a second sensor operably connected to the electronics, the toy in the package being internally powered with the electronics configured in the first mode, the method comprising the steps of:

user actuating the first sensor to cause the electronics to generate a first routine with the electronics in the first mode and to generate a second routine different from the first routine with the electronics in the second mode, at least the first sensor being exposed on the toy in the package for user actuation of the toy to generate the first routine in the package and at least the second sensor being covered in the package to prevent user actuation of the second sensor with the toy in the package;

removing the toy from the package sufficiently to expose at least the second sensor for user actuation;

user actuating the second sensor to cause the electronics to generate a third routine different from the first routine and to cause the electronics to be set to the second mode; and further including the step of retaining the electronics in the second mode each time electrical power to the electronics is interrupted and reapplied to the electronics after the user actuating the second sensor step.

12. A packaged toy comprising:

a toy including a plurality of user actuated switches, a computer chip controller in the toy operatively connected with each of the plurality of user actuated switches, and a plurality of preprogrammed routines stored in the toy, each routine directing controller activation and operation of the toy in a different way, the plurality of preprogrammed routines including at least a first set of one or more try-me routines and a second set of two or more normal routines, and each of the plurality of switches being associated with one or more particular routines of the plurality;

a package containing the toy and configured to expose one or more of the plurality of switches to permit user actuation of the at least the one or more exposed switches with the toy in the package and to cover at least one or more remaining switches of the plurality of switches to prevent user actuation of the one or more remaining switches with the toy in the package before the package is opened;

wherein the computer chip controller is configured to (1) initially execute only preprogrammed try-me routines of the first set in response to activations of the one or more switches of the plurality exposed to user actuation with the toy in the package, (2) self-set automatically into the second mode of operation in direct response to a first activation of any of the remaining switches of the plurality originally covered by the package and execute one of the preprogrammed normal routines of the second set in direct response to user activation of any of the remaining switches, both without further user input into the toy, and (3) thereafter execute preprogrammed normal routines from the second set in response to actuation of any of the one or more switches exposed to user actuation with the toy in the package, at least one of the preprogrammed normal routines executable by the controller after (2) in response to activation of any of the one or more switches initially exposed with the toy in the package being different from each of the preprogrammed try-me routines of the first set, whereby the toy automatically reconfigures itself from a try-me mode of operation to a normal play mode of operation.

13. The toy of claim 12 wherein the computer chip controller is electrically connected with each of the plurality of user actuated switches, wherein the toy further includes one or more electrically operated or electronically responsive devices other than the plurality of manually actuated switches also electrically connected to the computer chip controller for control of the device by the computer chip controller to perform all of the try-me routines of the first set and all of the normal routines of the second set.

14. A method of operating a toy originally provided in a package wherein the toy includes electronics configured to generate a plurality of routines and to operate in a first mode and in a second mode, a first sensor operably connected to the electronics, user actuation of which causes the electronics to generate a first routine with the electronics in the first mode and to generate a second routine different from the first routine with the electronics in the second mode, and a second sensor operably connected to the electronics, user actuation of which causes the electronics to generate a third routine different from the first routine and causes the electronics to be set to the second mode; wherein the package containing the toy is configured to expose the first sensor for actuation by a user with the toy contained in the package and to prevent user actuation of the second sensor with the toy contained in the package; and wherein the toy is provided in the package with the electronic in the first mode and power supplied to the electronics, the method comprising the steps of:

removing the toy from the package sufficiently to expose the second sensor for actuation;

manually actuating the second sensor with the electronics in the first mode and the first application of power still on the electronics to set the electronics into the second mode of operation and to generate a third routine operating the toy differently from the first routine, both without any further required user input; and manually actuating the first sensor with the electronics in the second mode and the first application of power still on the electronics to generate a second routine operating the toy differently from any first routine and from the third routine, the electronics being configured to generate the second routine only with the electronics in a mode of operation other than the first mode.

15. A method of configuring a toy for operation by a user, the toy comprising electronics configured to generate a plurality of routines and to operate in a first mode and in a second mode; a first sensor operably connected to the electronics, user actuation of which causes the electronics to generate a first routine with the electronics in the first mode and to generate a second routine, different from the first routine, with the electronics in the second mode; and a second sensor operably connected to the electronics, user actuation of which causes the electronics to generate a third routine, different from the first routine, and causes the electronics to be set to the second mode; the method comprising the steps of;

configuring the electronics to be in the first mode of operation upon a first application of power to the electronics;

configuring the electronics to thereafter respond to a manual actuation of the first sensor with the electronics in the first mode and the first application of power still on the electronics by generating a first routine operating the toy;

configuring the electronics to thereafter respond to a first manual actuation of the second sensor with the electronics in the first mode and the first application of power still on the electronics by automatically self-setting into the second mode of operation and generating a third routine operating the toy differently from the first routine without further user input; and configuring the electronics to thereafter respond to a manual actuation of the first sensor with the electronics in the second mode and the first application of power still on the electronics by generating a second routine operating the toy differently from the first routine and the third routine, the electronics being configured to generate the second routine only with the electronics in a mode of operation other than the first mode.

16. The toy configured by the method of claim 15.

17. A toy in a package, the toy comprising:

electronics configured to generate a plurality of routines and to operate in any of at least a first, try-me mode and a second, normal mode; and at least a first sensor and a second sensor, each sensor being operably connected to the electronics; and the package receiving the toy and being configured to expose at least the first sensor for actuation by a user with the toy in the package and to prevent user actuation of at least the second sensor with the toy in the package, the toy and the electronics being in the first, try-me mode in the package;

wherein the toy and the electronics are configured such that user activation of the first sensor with the toy in the first, try-me mode in the package causes the electronics to generate at least a first, try-me routine and with the toy and the electronics in the second, normal mode, to generate at least a second, normal routine different from the first, try-me routine; and wherein the toy and the electronics are further configured such that a first user activation of the second sensor causes the electronics to generate a third, normal routine different from the first, try-me routine, and also causes the electronics to automatically self-set to the second, normal mode without additional user input.

* * * * *